United States Patent [19]

von Conta

[11] Patent Number: 4,628,898

[45] Date of Patent: Dec. 16, 1986

[54] SECONDARY COMBUSTION SYSTEM FOR WOOD BURNING STOVE

[75] Inventor: Peter E. W. von Conta, Montgomery Center, Vt.

[73] Assignee: Hearthstone Corporation, Morrisville, Vt.

[21] Appl. No.: 762,266

[22] Filed: Aug. 5, 1985

Related U.S. Application Data

[63] Continuation-in-part of Ser. No. 584,082, Feb. 27, 1984, Pat. No. 4,553,526.

[51] Int. Cl.[4] ..... F24C 1/16

[52] U.S. Cl. ..... 126/58; 126/80; 126/83; 110/213

[58] Field of Search ..... 126/58, 79, 80, 69, 126/83, 290, 75, 76, 297, 77, 292; 110/210, 211, 213, 203

[56] References Cited

U.S. PATENT DOCUMENTS

| | | | |
|---|---|---|---|
| 6,824 | 10/1849 | Cole | 126/58 |
| 792,209 | 6/1905 | Gregory | 110/123 |
| 1,819,119 | 8/1931 | Pykosz | 126/58 |
| 2,481,165 | 9/1949 | Landry | 126/76 |
| 3,543,700 | 12/1970 | Baigas, Jr. | 110/213 |
| 3,861,335 | 1/1975 | Przewalski | 110/213 |

FOREIGN PATENT DOCUMENTS

| | | | |
|---|---|---|---|
| 662396 | 10/1928 | France | 126/58 |

*Primary Examiner*—Larry Jones

*Attorney, Agent, or Firm*—Prutzman, Kalb, Chilton & Alix

[57] ABSTRACT

A secondary combustion system for a wood burning stove employs an insulated passageway which is configured to substantially increase the turbulence of an exhaust stream passing therethrough. The insulated passageway comprises a generally transversely extending portion and a generally vertically extending portion. The passageway is configured to impart a rotation to the passing exhaust stream in one direction and to successively impart a rotation in the opposite direction. The insulated passageway comprises a plurality of helically extending channels. The passageway is also configured to have an increasing cross-sectional area to insure sufficient residence time for effecting the secondary combustion of the exhaust gases.

15 Claims, 5 Drawing Figures

SECONDARY COMBUSTION SYSTEM FOR WOOD BURNING STOVE

CROSS-REFERENCE TO RELATED APPLICATION

This application is a continuation-in-part of my copending U.S. application Ser. No. 584,082, filed Feb. 27, 1984 entitled Secondary Combustion System For Wood Burning Stove, now U.S. Pat. No. 4,553,526, 11/19/85.

BACKGROUND OF THE INVENTION

This invention relates to a system for controlling the emission of pollutants from a wood burning stove. More particularly, this invention relates to a system for effecting the secondary combustion of exhaust gases generated by the primary combustion of combustibles in a wood burning stove.

The increased popularity of wood burning stoves and wood burning technology has been tempered by the increased focus on the potential adverse environmental effects from pollutants and exhaust gases generated by wood burning stoves. A number of proposals have been advanced for reducing the pollutants generated by the wood burning process such as passing the exhaust gases through a catalytic combustor and/or various systems for effecting a secondary combustion of the exhaust gases. The necessity of improving the means for removing pollutants from the exhaust gases of wood burning stoves has been made evident by the increasing number of governmental regulations which legally restrict the atmospheric emissions of exhaust gases generated by wood burning stoves. The present invention is a new and improved secondary combustion system which is readily incorporated into a wood burning stove for combusting pollutants and the exhaust gases generated by the primary combustion.

BRIEF SUMMARY OF THE INVENTION

Briefly stated, the invention in a preferred form is an improved secondary combustion system for combusting the exhaust gases in a wood burning stove. The system employs an insulated conduit forming an insulated exhaust passageway having an intake opening from the fire box and an exit opening which leads to the exhaust opening of the stove. A dispersing member, which is preferably a generally flat screen having a plurality of apertures is interposed across the exhaust passageway in the vicinity of the intake opening to disperse exhaust gases which are injected through the intake opening from the fire box. The dispersing member functions to accelerate the exhaust gases and to facilitate the mixing of unconsumed oxygen from the primary combustion. The insulated conduit is configured so that a rotation is imparted to the gas stream in a first portion of the exhaust passageway. Secondary air is injected into the first portion of the passageway to add additional oxygen and to further increase the turbulence of the gas stream. A second portion of the conduit is configured so that a counter-rotation is imparted to the gas stream. In the second portion of the exhaust passageway, helically extending channels are formed in the conduit for promoting the counter-rotation. The second portion of the conduit is also structured so that the cross-sectional area of the formed exhaust passage increases thereby providing a means for decelerating the gas stream so that there is sufficient residence time in the exhaust passageway to effect secondary combustion. Direct flame impingement on the screen and into the chamber formed in the first portion of the passageway increases the temperature of the formed chamber sufficiently so that a self-sustaining secondary flame front is formed.

In a preferred embodiment of the invention, the exhaust passageway extends in a generally vertical orientation with a small transverse intake opening leading from the fire box. The intake opening portion of the passageway is rounded and the central vertical axis of the exhaust passageway is laterally offset from the intake opening to facilitate the imparting of the rotational motion to the exiting gas stream. The secondary air source is preferably injected at substantially a right angle to the advancing gas stream.

A method in accordance with the invention for removing pollutants from an exiting exhaust stream of unconsumed oxygen and exhaust gases produced by the combustion of combustibles in a wood burning stove involves injecting the exhaust gas stream into an insulated passageway. The exhaust stream is dispersed into a plurality of small stream segments flowing in divergent directions by passing the stream through a dispersion screen interposed in the passageway. The dispersed gases are recombined and inter-mixed in the passageway to form a more homogeneous mixture of the unconsumed oxygen and exhaust gases. The gas stream is accelerated due to the relatively small cross-sectional area of the initial portion of the passageway. A turbulence is imparted to the accelerated gas stream thereby facilitating the combusting of the exhaust gases in the presence of the unconsumed oxygen and secondary air which is injected into the gas stream. The step of imparting turbulence to the gas stream is accomplished by imparting a counter-clockwise rotation to the gas stream, changing the direction of the gas stream imparting a clockwise rotation to the gas stream and injecting secondary air at an angle to the direction of flow of the advancing air stream.

An object of the invention is to provide a new and improved secondary combustion system for combusting the exhaust gases produced by a wood burning stove.

Another object of the invention is to provide a new and improved secondary combustion system which is effective and may be efficiently incorporated into a wood burning stove.

A further object of the invention is to provide a new and improved secondary combustion system for a wood burning stove which system does not require catalytic combustor means.

Other objects and advantages of the invention will become apparent from the drawing and the specification.

DETAILED DESCRIPTION OF THE INVENTION

Figure 5:
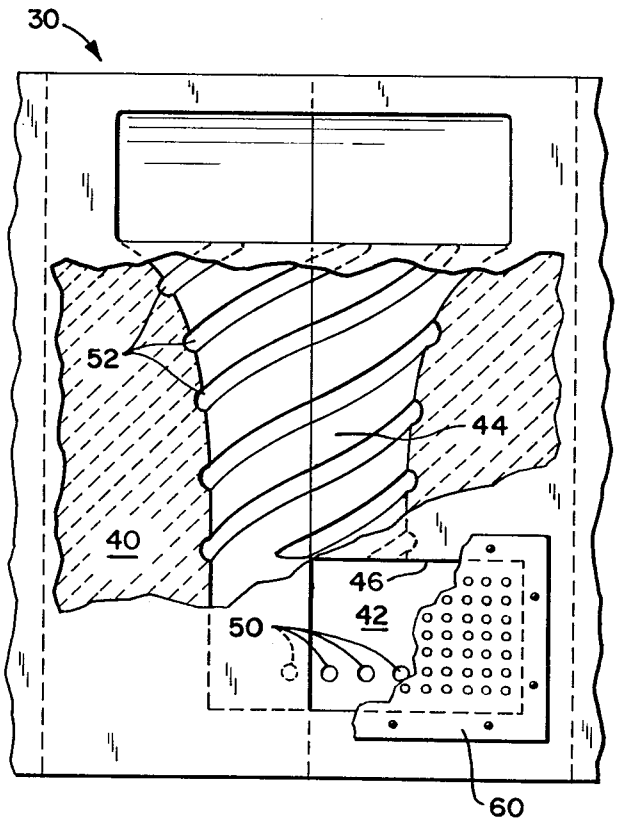
FIG. 5 is a fragmentary front view, partly broken away and partly in section, of the secondary combustion system of FIG. 2.

With reference to the drawing wherein like numerals represent like parts throughout the several FIGURES, a wood burning stove incorporating a secondary combustion system of the present invention is generally designated by the numeral 10. Wood burning stove 10, excepting for the secondary combustion system hereinafter described, may assume any of a number of forms. Stove 10 generally includes a housing 12 of cast iron, soapstone, or other suitable material. Housing 12 is supported on four legs 14. A door 16 or a pair of doors is located at the front of the housing for accessing a centrally located fire box chamber 18. An exhaust opening at the upper rear of the housing leads from an exhaust plenum 22 and communicates with an exhaust flue 24 in a conventional manner. Stove 10 is preferably of a compact construction which provides for an efficient controlled combustion of fuel received in fire box chamber 18 and for the exhaust of the exhaust gases to the exhaust flue 24.

Figure 2:
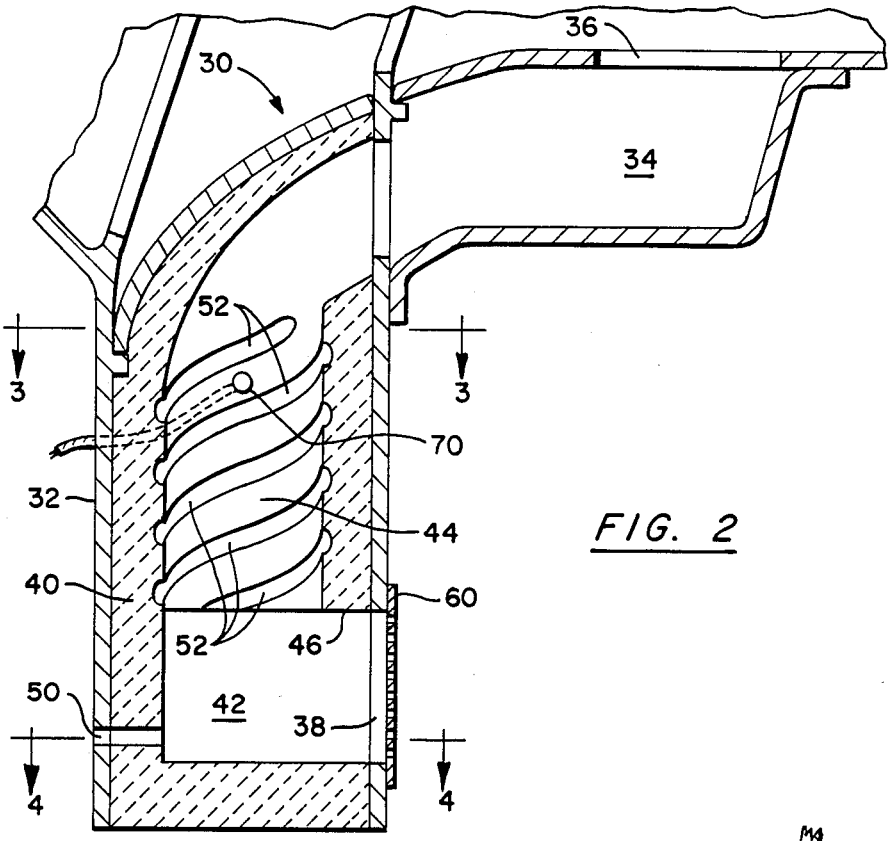
FIG. 2 is an enlarged fragmentary side sectional view of the secondary combustion system of FIG. 1.
Figure 3:
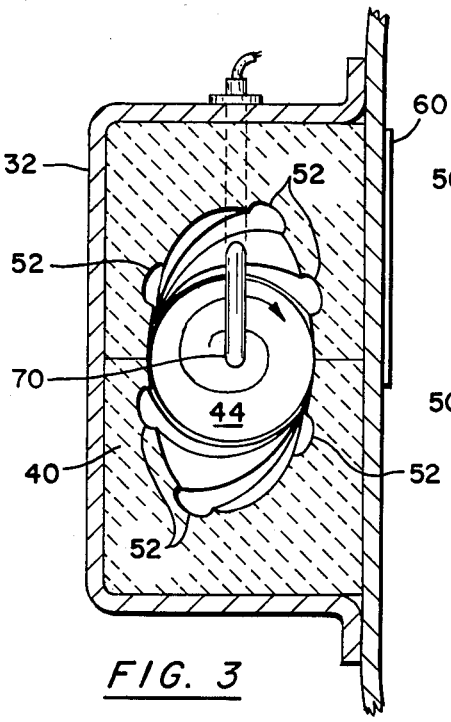
FIG. 3 is a sectional view of the secondary combustion system taken along the line 3—3 of FIG. 2.

With reference to FIG. 2 and FIG. 5, a secondary combustion system in accordance with the invention is generally designated by the numeral 30. Secondary combustion system 30 is located in the illustrated embodiment at the central rear interior of stove 10. The secondary combustion system may also be mounted at the central rear exterior of a wood burning stove. A conduit 32 extends vertically from the base of the housing interior to forwardly open into a generally transversely extending exhaust plenum 34. Exhaust plenum 34 forms in an upper forward portion an exhaust opening 36 which communicates via a second exhaust plenum 22 and exhaust opening 20 with exhaust flue 24. A forwardly protruding knob (not illustrated) may be employed for regulating a by-pass damper for controlling the exhaust path into the secondary combustion system 30.

An intake opening 38 is formed at a lower front portion of conduit 32 to provide direct communication between the fire box chamber 18 and the passageway formed by the conduit. Conduit 32 is lined with a thermal insulation layer 40 to form a generally vertically extending insulated passageway and a relatively short transverse passageway leading from intake opening 38 to exhaust plenum 34. Insulation layer 40 is a specially configured vacuum formed ceramic fiber material formed of allumina-silica ceramic fiber such as that marketed by Fire Line Incorporated of Youngstown, Ohio. The thermal insulation layer 40 may be precasted into sections and assembled to form the illustrated exhaust passageway. Other refractory-type materials capable of maintaining a high temperature level and capable of being configured as described below such as materials employed for lining kilns may also be suitable for insulation layer 40.

Insulation layer 40 forms a lower mixing chamber 42 which leads from intake opening 38 to a generally vertically extending exhaust passageway 44 which is also formed by the insulation layer. Mixing chamber 42 is partially defined by an upper surface 46 and a rounded side surface 48 which cooperate to direct exhaust gases exiting the fire box toward the central vertically extending exhaust passageway 44. The central vertical axis of exhaust passageway 44 is laterally offset from intake opening 38 so that exhaust gases entering the mixing chamber 42 through the intake opening traverse a quasi-lateral path before exiting vertically through exhaust passageway 44. A plurality of secondary air passages 50 open through the rear wall of mixing chamber 42. The secondary air passages 50 are disposed so that secondary air may be introduced or injected into the mixing chamber at an angle which is substantially perpendicular to the vertical axis of exhaust passageway 44.

Figure 4:
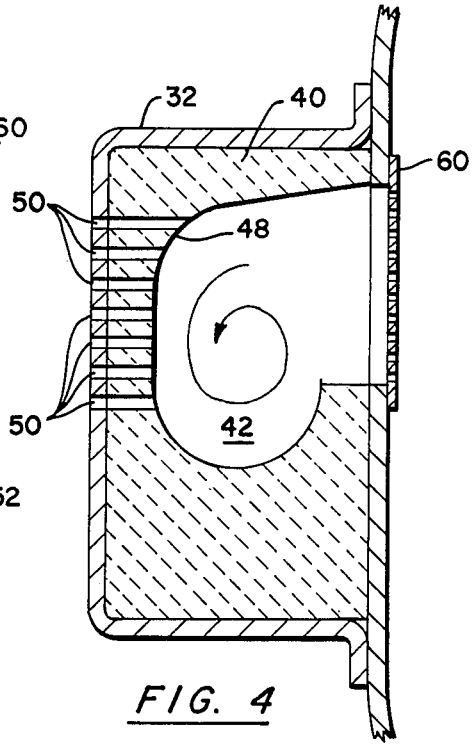
FIG. 4 is a sectional view of the secondary combustion system taken along the line 4—4 of FIG. 2.

A plurality of helically extending channels 52 are formed in the intermediate portion of insulation layer 40 which defines exhaust passageway 44. The helical channels or grooves 52 are substantially equidistantly spaced and are directionally oriented so that the vertical height at a location along the helical channels increases in accordance with the clockwise angular location as viewed in FIG. 4. In addition, the exhaust passageway 44 formed by the insulation layer gradually tapers from a substantially circular opening at the lower portion of the exhaust passageway to an enlarged oval-shaped opening at the top of the passageway as best illustrated in FIG. 4 so that the cross-sectional area of exhaust passageway 44 increases in area in accordance with the vertical height of the cross-section. The upper interior rear walls of insulation layer 40 are contoured toward exhaust plenum 34 so that the exhaust stream is directed to the exhaust plenum.

A generally flat screen 60 is mounted at intake opening 38 so that the exhaust gases exiting the fire box impinge and/or pass through the screen into mixing chamber 42. Screen 60 has a plurality of apertures which are preferably of a uniform size and are uniformly distributed. In preferred form, screen 60 may be manufactured from a 300 series stainless steel sheet with the apertures being dimensioned on the order of approximately ¼ inch in diameter.

A high temperature probe 70 may be positioned in the vertical exhaust passageway 44. Probe 70 is adapted for detecting relatively high temperatures and for providing an output signal to a controller for regulating an air inlet to the stove and for regulating the injection of secondary air through passages 50.

Figure 1:
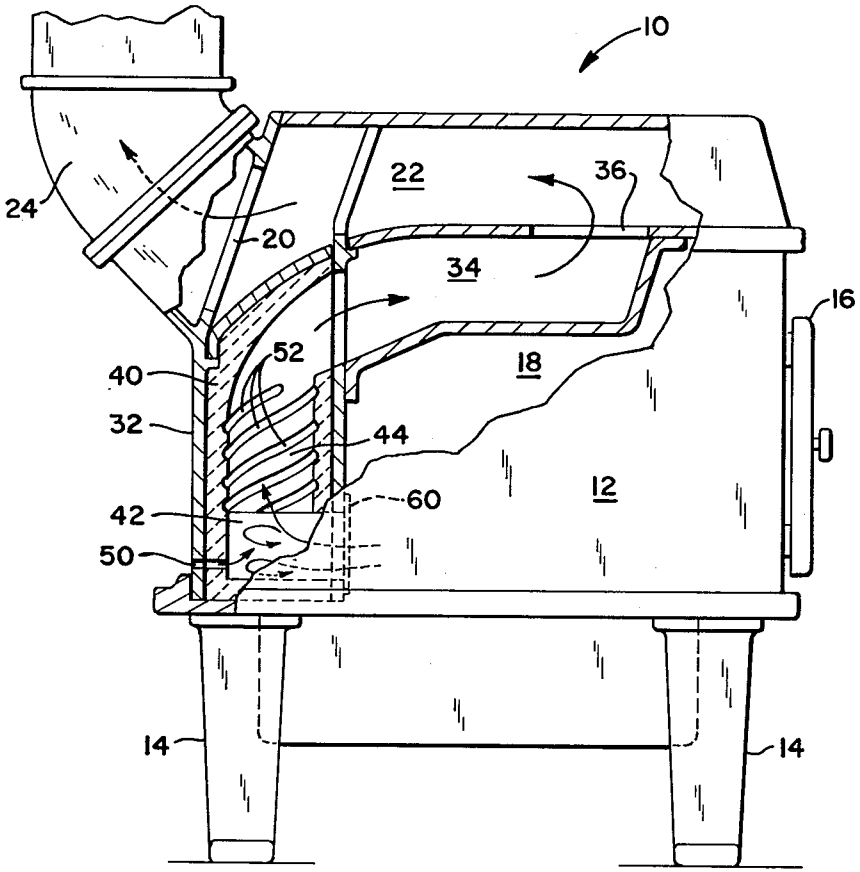
FIG. 1 is a side elevational view, partly broken away and partly in section, of a wood burning stove incorporating a secondary combustion system of the present invention.

In operation, an exhaust stream of unconsumed oxygen and the exhaust gases from the combustion of the combustibles in the fire box chamber 18 exits the fire box through intake opening 38 in a general direction of the arrows in FIG. 1. The exhaust stream encounters screen 60 which functions as a dispersing element for dispersing the exhaust stream into a plurality of small stream segments flowing in divergent directions in the mixing chamber 42. Screen 60 also functions as a constricting element for accelerating the exhaust stream. Secondary air is also injected into the formed mixing chamber through the inlet passages 50. The unconsumed oxygen and the exhaust gases are re-combined and inter-mixed in the mixing chamber to form a more homogenous exhaust stream mixture which is also mixed with the secondary air. The resulting exhaust stream mixture is vertically propelled in a generally upward direction in a very turbulent fashion. The high degree of turbulence results from the gas stream encountering screen 60, the shape of the mixing chamber which functions to impart a counter-clockwise helical rotation to the upwardly propelled exhaust stream, the directional change from essentially a transverse direction in the mixing chamber to essentially a vertical direction as the stream leaves the mixing chamber, and the impingement of the secondary air at an angle which is generally perpendicular to the advancing exhaust stream. The helical rotation is generally tangential to the general direction of flow of the advancing gas stream.

The turbulence of the gas stream is further exaserbated by the passing of the gas stream through the exhaust passageway 44. The helical channels 52 function to impart a generally clockwise helical rotation to the advancing gas stream which has a generally counterclockwise helical rotation prior to encountering the channel. The inter-mixed exhaust stream ignites as a result of direct flame impingement into mixing chamber 42 and the heating of screen 60. Under suitable conditions, a sustaining secondary flame front forms on the downstream side of screen 60. The secondary flame front is self-sustaining as temperatures within the insulated passageway reach 1200° F. The exhaust stream from the secondary combustion within the insulated passageway is relatively clean and eventually exits via exhaust plenum 34 and plenum 22 to the exhaust flue 24 in a general direction indicated by the arrows in FIG. 1. The entire insulated passageway essentially forms a secondary combustion chamber.

A temperature probe 70 may be located in the formed secondary combustion chamber for sensing the local temperature and transmitting a signal indicative of the sensed temperature to a controller unit. The controller unit functions to adjust the air inlets to the fire box and to control the injection of secondary air through the air passages 50 in accordance with the detected temperatures. A suitable probe is the VT Group High-Temp Probe marketed by Vermont Technology Group, Inc. It should be noted that the formed secondary combustion passageway is insulated to retain the high temperatures of the exhaust gases within the exhaust passageway so that the exhaust stream is essentially dispersed, inter-mixed, accelerated, imparted with turbulence and secondarily combusted in a substantially thermally isolated environment.

The intake opening 38 is dimensioned to provide a relatively restricted opening in relation to the fire box chamber 18 so that a relatively high velocity exhaust stream exits into the secondary combustion system. For example, in a preferred stove embodiment wherein the fire box chamber has dimensions on the order of 18"×10"×13", intake opening 38 has an opening area of approximately 14 sq. inches. In order to maintain the initial relatively high velocity of the exhaust stream within the secondary combustion system, the insulated passageway formed by insulation layer 40 is a relatively narrow passageway having initially a small substantially uniform cross-sectional area which is approximately equal to the area of the intake opening. The cross-sectional area of the intake opening increases along the exhaust path to allow more residence time for the exhaust stream within the passageway to thereby facilitate the secondary combustion.

In preliminary tests employing the foregoing described secondary combustion system 10 wherein the exhaust gases within the fire box were between 700° F. and 1100° F., the exhaust temperatures in the mixing chamber 42 were on the order of 1500° F. to 2000° F. due to the insulation of the chamber, the acceleration of the exhaust stream and the increased turbulence of the exhaust stream. Under such conditions a secondary flame front was formed at the downstream side of screen 60. Temperatures between 1600° F. and 2000° F. were detected by a high temperature probe 70 which was located within the formed secondary combustion chamber. At a location approximately 4 feet up into the exhaust flue, the temperatures of relatively clean exhaust gases were measured at approximately 450° F. The oxygen content of the flue exhaust gases was as low as 3–5%. The flue exhaust gas stream also had a carbon dioxide content on the order of 18% and a carbon monoxide content on the order of 0–0.025%.

The foregoing description of the secondary combustion system for a wood burning stove has been set forth for purposes of illustration and should not be deemed a limitation of the invention herein. Accordingly, various modifications, adaptations, and alternatives may occur to one skilled in the art without departing from the spirit and scope of the present invention.

What is claimed is:

1. An improved secondary combustion system for combusting the exhaust gases exiting from a fire box in a wood burning stove comprising:

an insulated conduit defining an exhaust passageway leading from an intake opening to an exit opening;

screen means interposed across said exhaust passageway in the vicinity of said intake opening to impart a rapid acceleration to a gas stream entering said exhaust passageway;

rotation means to impart a rotation to the gas stream in a first portion of said exhaust passageway;

counter-rotation means to impart a counter-rotation to the gas stream in a second portion of said exhaust passageway;

deceleration means to decelerate the gas stream in the second portion of said exhaust passageway; and secondary air means to inject a source of secondary air into said exhaust passageway.

2. The secondary combustion system of claim 1 wherein said exhaust passageway comprises a generally transversely extending segment and a generally vertically extending segment.

3. The improved secondary combustion system of claim 2 wherein the central axis of said second portion is laterally offset from the central axis through said intake opening.

4. The secondary combustion system of claim 1 wherein said counter-rotation means comprises a plurality of helically extending channels formed in the wall of said insulated conduit.

5. The secondary combustion system of claim 1 wherein said deceleration means comprises an exhaust passageway configuration wherein the cross-sectional area of said passageway increases in accordance with the distance from said intake opening.

6. The secondary combustion system of claim 1 wherein said secondary air means comprises a plurality of air orficies opening into said first portion so that the source of secondary air is injected at substantially a right angle to the direction of travel of the gas stream.

7. The secondary combustion system of claim 1 wherein said insulated conduit is formed from a ceramic fiber.

8. A wood burning stove comprising:

a fire box with an outlet opening therein;

an insulated conduit defining an exhaust passageway leading from said outlet opening and defining a generally transversely and vertically extending exhaust path for a gas stream exiting said fire box;

a screen interposed across said exhaust passageway in the vicinity of said outlet opening to disperse and accelerate the gas stream entering said exhaust passageway from said fire box;

a first portion of said conduit being configured to impart a rotation to the advancing gas stream;

a second portion of said conduit forming a generally helically extending channel structure to impart a counter-rotation to the vertically advancing gas stream and forming a passageway cross-sectional area which generally increases in accordance with the vertical distance from said outlet opening; and secondary air means to inject a source of secondary air into said exhaust passageway at an angle to the general direction of flow of the gas stream.

9. The wood burning stove of claim 8 wherein said first portion forms a chamber partially defined by a rounded wall and an upper surface so that a gas stream entering said chamber is transversely deflected to a generally vertical exit from said chamber wherein the gas stream has a generally helical rotational component which is generally tangential to the general direction of flow of the gas stream.

10. The wood burning stove of claim 8 wherein said secondary air means injects a source of secondary air into the first portion of said conduit at substantially a right angle to the vertical gas stream flow.

11. The wood burning stove of claim 8 wherein said second portion gradually tapers from a generally circular shaped cross-section to an enlarged generally oval shaped cross-section.

12. The wood burning stove of claim 8 wherein an exhaust plenum extends generally transversely from the exit opening of said insulated exhaust passageway.

13. A method for removing pollutants from an exiting exhaust stream of unconsumed oxygen and exhaust gases produced by the combustion of combustibles in a wood burning stove comprising:

(a) dispersing the exhaust stream into a plurality of small stream segments flowing in divergent directions;

(b) re-combining and inter-mixing the stream segments to form a gas stream having more homogeneous mixture of the unconsumed oxygen and the exhaust gases;

(c) adding secondary air to the formed mixture;

(d) imparting a turbulence to the accelerated gas stream thereby combusting the exhaust gases in the presence of the unconsumed oxygen and secondary air by changing the direction of the exhaust stream and imparting successive rotations and counter-rotations to the exhaust stream.

14. The method of claim 13 wherein steps (a) through (d) are performed in a substantially thermally isolated environment.

15. The method of claim 14 wherein step (d) further comprises injecting a source of secondary air at an angle to the general direction of flow of the exhaust stream.

* * * * *